US009247769B2

(12) United States Patent
Snow et al.

(10) Patent No.: US 9,247,769 B2
(45) Date of Patent: Feb. 2, 2016

(54) WRAPPER HAVING REDUCED IGNITION PROCLIVITY CHARACTERISTICS

(71) Applicant: Schweitzer-Mauduit International, Inc., Alpharetta, GA (US)

(72) Inventors: Larry D. Snow, Alpharetta, GA (US); Francois Mongeon, Little Mountain, SC (US); Thomas A. Kraker, Alpharetta, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 0 days.

(21) Appl. No.: 14/051,624

(22) Filed: Oct. 11, 2013

(65) Prior Publication Data

US 2014/0102465 A1 Apr. 17, 2014

Related U.S. Application Data

(60) Provisional application No. 61/783,632, filed on Mar. 14, 2013, provisional application No. 61/712,621, filed on Oct. 11, 2012.

(51) Int. Cl.

| | |
|---|---|
| ***A24D 1/16*** | (2006.01) |
| ***D21H 19/00*** | (2006.01) |
| ***D21H 27/02*** | (2006.01) |
| ***A24D 1/02*** | (2006.01) |

(52) U.S. Cl.

CPC ..... *A24D 1/025* (2013.01)

(58) Field of Classification Search

USPC ..... 162/139, 158, 159, 175, 181.1; 131/105, 360, 365; 229/87.12, 87.14

See application file for complete search history.

(56) References Cited

U.S. PATENT DOCUMENTS

| | | | |
|---|---|---|---|
| 1,996,002 | A | 5/1933 | Seaman |
| 2,013,508 | A | 5/1933 | Seaman |
| 2,003,690 | A | 6/1935 | Lewton |
| 2,673,799 | A | 3/1954 | Schur et al. |
| 2,776,912 | A | 1/1957 | Gregory |
| 3,215,579 | A | 11/1965 | Hagen |
| 3,351,479 | A | 11/1967 | Fairchild |

(Continued)

FOREIGN PATENT DOCUMENTS

| | | |
|---|---|---|
| CA | 2319855 | 3/2000 |
| DE | 10146810 | 4/2003 |

(Continued)

OTHER PUBLICATIONS

"Determination of Diffusion Capacity by Measurement of CO2 Transfer Rate Through Materials Used as Cigarette Papers and Cigarette Papers Having an Oriented Zone of Reduced Diffusion Capacity", Coresta Recommended Meth. 77,[online], 2014,retrieved from the Internet, [retrieved Nov. 8, 2014], <URL:http://www.coresta.org/Recommended_Methods/CRM_77.pdf>.*

(Continued)

*Primary Examiner* — Dennis Cordray

(74) *Attorney, Agent, or Firm* — Dority & Manning, P.A.

(57) ABSTRACT

Wrappers for smoking articles are disclosed having reduced ignition proclivity characteristics. The wrappers include discrete areas treated with a reduced ignition composition. In accordance with the present disclosure, the amount of burn promoting agents is controlled over the surface of the wrapper in order to, in one embodiment, increase the permeability of the treated areas.

25 Claims, 2 Drawing Sheets

(56) References Cited

U.S. PATENT DOCUMENTS 3,353,541 A 11/1967 Hind et al.
3,386,449 A 6/1968 Hind
3,415,253 A 12/1968 Michels et al.
3,420,241 A 1/1969 Hind et al.
3,428,053 A 2/1969 Schoenbaum et al.
3,467,109 A 9/1969 Block et al.
3,472,237 A 10/1969 Stephens
3,483,874 A 12/1969 Hind
3,511,247 A 5/1970 Tamol
3,526,904 A 9/1970 Tamol
3,561,451 A 2/1971 Jacin et al.
3,599,153 A 8/1971 Lewis et al.
3,620,801 A 11/1971 O'Grady
3,621,851 A 11/1971 Heskett et al.
3,699,973 A 10/1972 Tamol et al.
3,736,940 A 6/1973 Saint-Pastou
3,760,815 A 9/1973 Deszyck
3,805,799 A 4/1974 Stewart et al.
3,847,164 A 11/1974 Mattina et al.
3,860,012 A 1/1975 Selke
3,911,932 A 10/1975 Houck, Jr. et al.
3,949,762 A 4/1976 West et al.
4,077,414 A 3/1978 Baker et al.
4,129,134 A 12/1978 Hind et al.
4,140,760 A 2/1979 Withington
4,146,040 A 3/1979 Cohn
4,182,349 A 1/1980 Selke
4,193,412 A 3/1980 Heim et al.
4,222,740 A 9/1980 Bohrn et al.
4,239,591 A 12/1980 Blake
4,267,240 A 5/1981 Jaisle et al.
4,303,084 A 12/1981 Simon
4,351,638 A 9/1982 Finlayson, III et al.
4,386,108 A 5/1983 Richter
4,410,899 A 10/1983 Haruta et al.
4,412,224 A 10/1983 Sugitani
4,452,259 A 6/1984 Norman et al.
4,453,553 A 6/1984 Cohn
4,461,311 A 7/1984 Mathews et al.
4,463,359 A 7/1984 Ayata et al.
4,481,960 A 11/1984 Brooks
4,489,738 A 12/1984 Simon
4,532,530 A 7/1985 Hawkins
4,543,370 A 9/1985 Porter et al.
4,561,454 A 12/1985 Guess
4,590,955 A 5/1986 Dixit
4,601,777 A 7/1986 Hawkins et al.
4,607,647 A 8/1986 Dashley et al.
4,615,345 A 10/1986 Durocher
4,622,983 A 11/1986 Mathews et al.
4,665,648 A 5/1987 Branco et al.
4,674,519 A 6/1987 Keritsis et al.
4,679,575 A 7/1987 Yamaguchi et al.
4,739,775 A 4/1988 Hampl, Jr.
4,784,164 A 11/1988 Adams et al.
4,805,644 A 2/1989 Hampl, Jr.
4,880,870 A 11/1989 Zimmermann et al.
4,889,145 A 12/1989 Adams et al.
4,924,888 A 5/1990 Perfetti et al.
4,928,715 A 5/1990 Mentzel et al.
4,945,932 A 8/1990 Mentzel et al.
4,984,589 A 1/1991 Riedesser
4,998,542 A 3/1991 Kallianos et al.
5,040,551 A 8/1991 Schlatter et al.
5,057,606 A 10/1991 Garbe
5,060,675 A 10/1991 Milford et al.
5,092,353 A 3/1992 Montoya et al.
5,106,417 A 4/1992 Hauser et al.
5,125,421 A 6/1992 Mitchell
5,131,416 A 7/1992 Gentry
5,143,098 A 9/1992 Rogers
5,143,099 A 9/1992 Le Gars et al.
5,144,966 A 9/1992 Washington
5,161,549 A 11/1992 Rosario
5,170,807 A 12/1992 Kasbo et al.
5,178,167 A 1/1993 Riggs et al.
5,220,930 A 6/1993 Gentry
5,221,502 A 6/1993 Washington
5,261,425 A 11/1993 Raker et al.
5,263,999 A 11/1993 Baldwin et al.
5,271,419 A 12/1993 Arzonico et al.
5,281,261 A 1/1994 Lin
5,316,575 A 5/1994 Lent et al.
5,393,333 A 2/1995 Trouve
5,417,228 A 5/1995 Baldwin et al.
5,450,862 A 9/1995 Baldwin et al.
5,450,863 A 9/1995 Collins et al.
5,474,095 A 12/1995 Allen et al.
5,503,876 A 4/1996 Fields et al.
5,523,014 A 6/1996 Dolan et al.
5,534,114 A 7/1996 Cutright et al.
5,540,242 A 7/1996 Chao et al.
5,563,644 A 10/1996 Isganitis et al.
5,690,787 A 11/1997 Hultman et al.
5,715,844 A 2/1998 Young et al.
5,722,433 A 3/1998 Ishino et al.
5,724,998 A 3/1998 Gellatly et al.
5,764,257 A 6/1998 Miyazawa et al.
5,765,570 A 6/1998 Litzinger et al.
5,820,998 A 10/1998 Hotaling et al.
5,849,153 A 12/1998 Ishino et al.
5,878,753 A 3/1999 Peterson et al.
5,878,754 A 3/1999 Peterson et al.
5,893,372 A 4/1999 Hampl, Jr.
5,997,691 A 12/1999 Gautam et al.
6,129,087 A 10/2000 Wallace et al.
6,181,439 B1 1/2001 Bronstein et al.
6,286,516 B1 9/2001 Bowen et al.
6,289,898 B1 9/2001 Fournier et al.
6,298,780 B1 10/2001 Ben-Horin et al.
6,298,860 B1 10/2001 Hampl et al.
6,305,382 B1 10/2001 Hampl, Jr.
6,314,964 B1 11/2001 Hampl, Jr.
6,371,127 B1 4/2002 Snaidr
6,568,403 B2 5/2003 Hampl, Jr. et al.
6,584,981 B2 7/2003 Hampl, Jr.
6,606,999 B2 8/2003 Crooks et al.
6,615,842 B1 9/2003 Cerami et al.
6,637,439 B2 10/2003 Hajaligol et al.
6,645,605 B2 11/2003 Hammersmith et al.
6,679,270 B2 1/2004 Baskevitch et al.
6,701,936 B2 3/2004 Shafer et al.
6,705,325 B1 3/2004 Hicks et al.
6,722,373 B2 4/2004 Bowen et al.
6,725,867 B2 4/2004 Peterson et al.
6,748,955 B2 6/2004 Snaidr et al.
6,769,437 B2 8/2004 Hajaligol et al.
6,779,530 B2 8/2004 Kraker
6,799,578 B2 10/2004 Snaidr et al.
6,810,884 B2 11/2004 Snaidr et al.
6,823,872 B2 11/2004 Hampl, Jr.
6,827,087 B2 12/2004 Wanna et al.
6,837,248 B2 1/2005 Zawadzki
6,854,469 B1 2/2005 Hancock et al.
6,860,274 B2 3/2005 Matsufuji et al.
6,929,013 B2 8/2005 Ashcraft et al.
7,017,586 B2 3/2006 Tsutsumi et al.
7,165,553 B2 1/2007 Luan et al.
7,219,672 B2 5/2007 Tosas Fuestes et al.
7,234,471 B2 6/2007 Fitzgerald et al.
7,308,898 B2 12/2007 Monsalud, Jr. et al.
7,448,390 B2 11/2008 Barnes et al.
7,600,518 B2 10/2009 Oglesby et al.
7,749,957 B2 7/2010 Ittel et al.
7,775,217 B2 8/2010 Seymour et al.
7,836,898 B2 11/2010 Zawadski et al.
8,097,442 B2 1/2012 Hitchman et al.
8,375,959 B2 2/2013 Dittrich et al.
8,646,464 B2 2/2014 Hampl, Jr. et al.
2002/0139381 A1 10/2002 Peterson et al.
2002/0179105 A1 12/2002 Zawadski et al.
2002/0179106 A1 12/2002 Zawadski et al.
2003/0131860 A1 7/2003 Ashcraft
2003/0136240 A1 7/2003 Thomas

(56) References Cited

U.S. PATENT DOCUMENTS

| | | | |
|---|---|---|---|
| 2003/0136420 | A1 | 7/2003 | Kraker |
| 2003/0145869 | A1 | 8/2003 | Kitao et al. |
| 2003/0150466 | A1 | 8/2003 | Kitao et al. |
| 2003/0164173 | A1 | 9/2003 | Zawadski et al. |
| 2004/0007242 | A1 | 1/2004 | Finlay et al. |
| 2004/0011368 | A1 | 1/2004 | Tsutsumi et al. |
| 2004/0020502 | A1 | 2/2004 | Tosas Fuestes et al. |
| 2004/0020504 | A1 | 2/2004 | Snaidr et al. |
| 2004/0084174 | A1 | 5/2004 | Ishikawa et al. |
| 2004/0094174 | A1 | 5/2004 | Ishikawa |
| 2004/0123874 | A1 | 7/2004 | Zawadzki et al. |
| 2004/0123966 | A1 | 7/2004 | Altman et al. |
| 2004/0134631 | A1 | 7/2004 | Crooks et al. |
| 2004/0182407 | A1 | 9/2004 | Peterson et al. |
| 2004/0221861 | A1 | 11/2004 | Eibl |
| 2004/0255966 | A1 | 12/2004 | Kraker |
| 2005/0005947 | A1 | 1/2005 | Hampl, Jr. et al. |
| 2005/0056294 | A1 | 3/2005 | Wanna et al. |
| 2005/0194014 | A1 | 9/2005 | Reed, Jr. |
| 2005/0241659 | A1 | 11/2005 | Ashcraft et al. |
| 2005/0241660 | A1 | 11/2005 | Ashcraft et al. |
| 2007/0084475 | A1 | 4/2007 | Oglesby |
| 2007/0137668 | A1 | 6/2007 | Borschke et al. |
| 2007/0169786 | A1 | 7/2007 | Li et al. |
| 2007/0246055 | A1 | 10/2007 | Oglesby |
| 2007/0251658 | A1 | 11/2007 | Gedevanishvili et al. |
| 2007/0295348 | A1 | 12/2007 | Wanna |
| 2008/0115794 | A1 | 5/2008 | Oglesby |
| 2008/0202542 | A1 | 8/2008 | Hampl et al. |
| 2009/0120450 | A1 | 5/2009 | Herve et al. |
| 2009/0159090 | A1 | 6/2009 | Pienemann |
| 2009/0301506 | A1 | 12/2009 | Kida et al. |
| 2011/0030709 | A1 | 2/2011 | Sebastian et al. |
| 2011/0041862 | A1 | 2/2011 | Volgger et al. |
| 2011/0290436 | A1 | 12/2011 | Dumas et al. |

FOREIGN PATENT DOCUMENTS

| | | |
|---|---|---|
| EP | 0193607 | 1/1989 |
| EP | 0419975 | 4/1991 |
| EP | 0601933 | 6/1994 |
| FR | 2763080 | 11/1998 |
| FR | 2970153 | 7/2012 |
| GB | 848332 | 8/1956 |
| GB | 903067 | 8/1962 |
| GB | 2100572 | 1/1983 |
| WO | WO 81/02243 | 8/1981 |
| WO | WO 98/16125 | 4/1998 |
| WO | WO 99/53778 | 10/1999 |
| WO | WO 00/11976 | 3/2000 |
| WO | WO 01/41590 | 6/2001 |
| WO | WO 02/43513 | 6/2002 |
| WO | WO 03/064165 | 8/2003 |
| WO | WO 2012/013334 A1 * | 2/2012 |

OTHER PUBLICATIONS

James P. Casey, "Pulp and Paper Chemistry and Chemical Technology," Third Edition, vol. 2., Edited by James Casey, 2010-547679 dated Apr. 25, 2001.

Kimberly-Clark, Product List of Cigarette Papers, 5 pages (Nov. 3, 1993).

Ecusta, Standard Products Catalog of Cigarette papers, 3 pages (Apr. 15, 1987).

Publication, "Relative Ignition Propensity of Test Market Cigarettes", Richard G. Gann, et al., National Institute of Standards and Technology, Technology Administration, U.S. Department of Commerce, Jan. 2001.

Publication. "The Effect of Cigarette Characteristics on the Ignition of Soft Furnishings", Richard G. Gann, et al., Center for Fire Research National Bureau of Standards, Oct. 1987.

Publication, "Overview: Practicability of Developing a Performance Standard to Reduce Cigarette Ignition Propensity", U.S. Consumer Product Safety Commission, Aug. 1993.

Publication, "Werkstoffe der Papierverarbeitung", Lehmann et al., Deutscher Fachverlag, Gmbh, Frankfurt (Main), 1979, pp. 110-115 (XP002529473).

Publication, "Rauigkeit als vernachlassigte Einflussgrosse der Druckqualitat", Steiger et al., Ugra Mitteilungen, 2004, p. 34-37 (XP002529472).

Publication, "Determination of Paper Filler Z-distribution by Low Vacuum SEM and EDX", Roux et al., Journal of Microscopy, vol. 229, pt. 1, Revised Oct. 24, 2006, accepted Jul. 24, 2007, pp. 44-59.

Product Data Sheet for Mapico® High-Purity Synthetic Iron Oxide Yellow 1135, Aug. 16, 2001.

Program Booklet and Abstracts, vol. 57, 57th Tobacco Science Research Conference, Sep. 21-24, 2003, Norfolk, Virginia, 2 pages.

Abstract of Article—The effect of tobacco ingredients on smoke chemistry. Part I: Flavourings and additives, R. R. Baker, Silva de Pereira, Jr., and G. Smith, Food Chem. Toxicol., vol. 42, 2004, Suppl:S3-37, 2 pages.

Hoffmann, Dietrich and Hoffmann, Ilse (1997), The Changing Cigarette, 1950-1995, Mar. 1997, Journal of Toxicology and Environmental Health, Part A, 50:4, 307-364.

MacEvoy, Bruce, Synthetic Inorganic Pigments, Jul. 2008, www.handprint.com/HP/WCL/pigmt1b.ntml, accessed Nov. 16, 2010.

Pulp And Paper Chemistry and Chemical Technology, third Edition, vol. III by James P. Casey—Editor—A Wiley-Interscience Publication—pp. 1517-1521 & pp. 1702-1703.

Publication, "Cigarette Ignition Performance", J.T. Wanna and P.X. Chen, Journal of Fire Sciences, vol. 19, Sep./Oct. 2001, pp. 355-368.

German Standard, DIN ISO 2965, Materials used as cigarette papers, filter plug wrap and filter joining paper, including materials having an oriented permeable zone—Determination of air permeability, Jan. 2000, 19 pages.

International Search Report and Written Opinion for application No. PCT/US2013/064560 dated Mar. 27, 2014.

Information Offer Form, submitted Mar. 7, 2013. (210-547679).

Measurement of Gas Diffusion Capacity of Cigarette Papers by Alan B. Norman, et al., R.J. Reynolds Tobacco Company, Beitrage zur Tabakforschung International/contributions to Tobacco Research, vol. 21, No. 8., Dec. 2005.

Results of Duofomer-D Operations. Formation and Physical Properties of Woodfree Coating base and Fine Paper From No. 2 PM of Nippon Kakoh Seishi K.K.,Japan Tappi Journal, ISSN:0022-815X, vol. 47., No. 8, Abstract, Takao Abe, 2010-547679 dated Mar. 25, 2008, pp. 1-4.

Patent Abstract of JP2004229541 dated Aug. 19, 2004, 2 pages.

Patent Abstract of JP H1121795 dated Jan. 26, 1999, 2 pages.

* cited by examiner

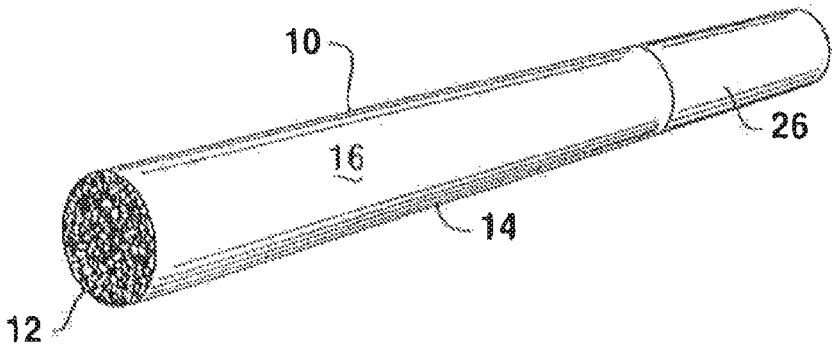
FIG. —1—
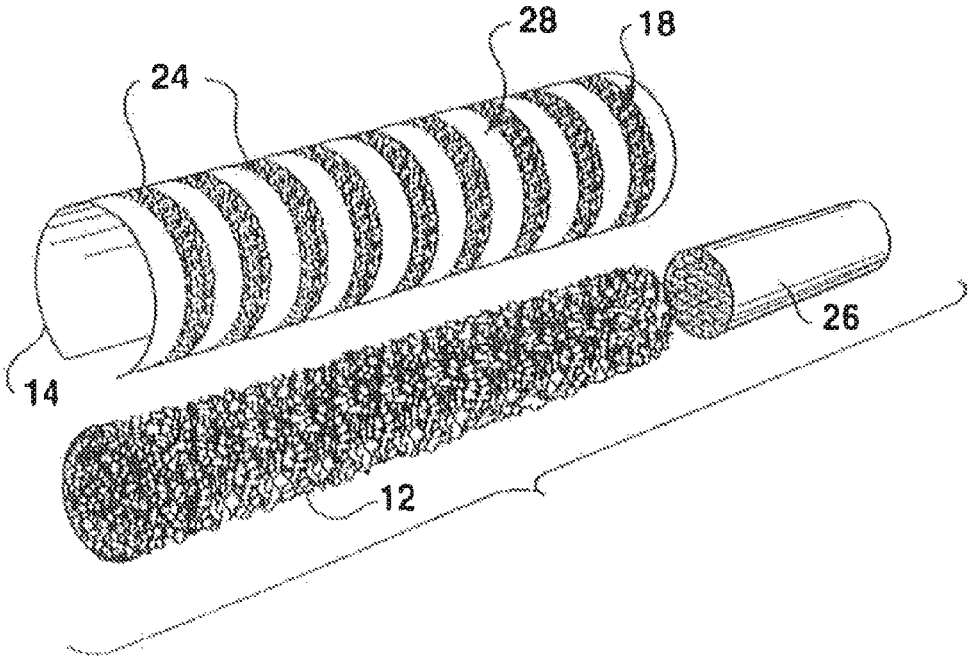
FIG. —2—

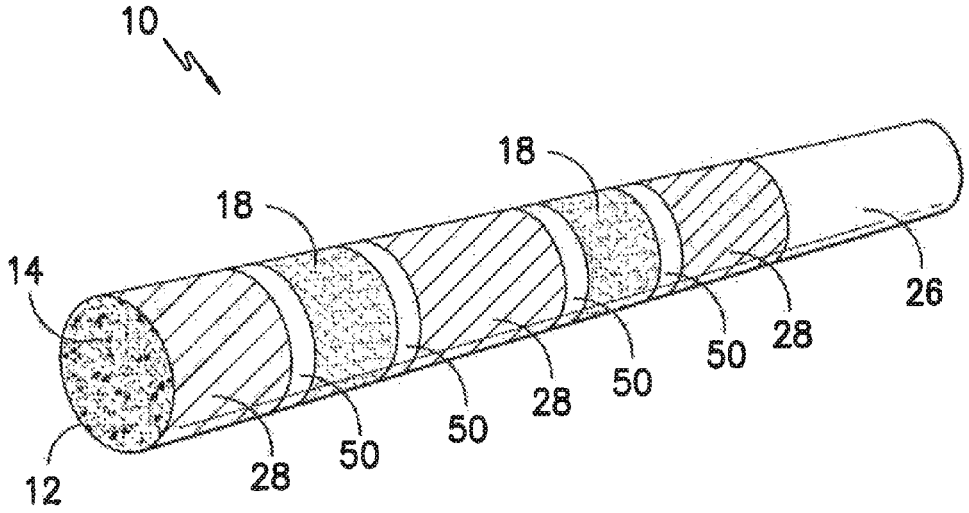
FIG. —3—

WRAPPER HAVING REDUCED IGNITION PROCLIVITY CHARACTERISTICS

RELATED APPLICATIONS

This application is based on and claims priority to U.S. patent application Ser. No. 61/783,632, filed on Mar. 14, 2013 and U.S. patent application Ser. No. 61/712,621, filed on Oct. 11, 2012, both of which are incorporated herein by reference in their entirety.

BACKGROUND

There is an ongoing concern in the tobacco industry to produce cigarettes having wrappers which reduce the ignition proclivity of the smoking article, or the tendency of the smoking article to ignite surfaces which come into contact with the lit smoking article. Reports have been made of fires attributed to burning cigarettes coming into contact with combustible materials. A justifiable interest exists in the industry to reduce the tendency of cigarettes, or other smoking articles to ignite surfaces and materials used in furniture, bedding, and the like upon contact.

Thus, a desirable feature of smoking articles, particularly cigarettes, is that they tend to self-extinguish upon being dropped or left in a free burning state on combustible materials.

It has long been recognized in the tobacco industry that the cigarette wrapper can have a significant influence on the smolder characteristics of the cigarette. In this regard, various attempts have been made in the art to alter or modify the cigarette wrappers in order to achieve the desired tendency of the cigarette to self-extinguish, or in other words to reduce the ignition proclivity characteristics of cigarettes.

The prior art describes the application of film-forming compositions or alternatively cellulosic fibrous compositions to cigarette paper to reduce the paper permeability and control the burn rate. It has been shown that when these materials have been applied in discrete areas along the length of the cigarette, the cigarette shows a reduced propensity to ignite a substrate and tends to self-extinguish.

U.S. Pat. No. 5,878,753 to Peterson et al., U.S. Pat. No. 6,779,530 to Kraker, and U.S. Pat. No. 6,725,867 to Peterson et al., which are incorporated herein by reference, for example, describe a smoking article wrapper being treated with a film-forming composition to reduce ignition proclivity. U.S. Pat. No. 5,878,754 to Peterson et al. which is also incorporated herein by reference describes a smoking article wrapper being treated with a non-aqueous solution of a solvent soluble polymer dissolved in a non-aqueous solution to reduce ignition proclivity.

Although the above patents have provided great advancements in the art, further improvements are still needed. For instance, the discrete areas formed on the wrapper that are intended to reduce ignition proclivity can have various adverse effects on the smoking article. The treated discrete areas, for instance, generally have a lower permeability than the base wrapper. The lower permeability in the treated areas can have an adverse impact upon the enjoyment of the smoking article, creating mainstream smoke with a harsh taste in comparison to the remainder of the smoking article.

In the past, in order to counteract some of the above effects, treated discrete areas were produced having a permeability that gradually changed from a minimum to a maximum over the width of the treated discrete areas in the direction of the burning coal. This arrangement has provided various improvements.

In the past, particular film-forming compositions have been proposed that contain a film-forming material having a relatively low molecular weight. These film-forming compositions were applied to the wrapper at relatively high solids concentrations. This arrangement also allowed for some improvement in controlling permeability of the treated discrete areas.

Further improvements, however, are still needed. For instance, a need exists for a wrapper for a smoking article having treated discrete areas in which the treated discrete areas have a relatively high permeability. Specifically, a need exists for a method of increasing the permeability in the treated areas without having to be limited to particular film-forming materials.

A need also exists for producing treated discrete areas on a wrapper that reduce the ignition proclivity of a smoking article to desired levels while having a minimal impact upon permeability and while also using a minimal amount of material added to the wrapper.

SUMMARY

The present disclosure is generally directed to paper wrappers for smoking articles with reduced ignition proclivity and to a process for producing the wrappers.

In one embodiment, for instance, the present disclosure is directed to a wrapper for a smoking article. The wrapper comprises a paper substrate comprising cellulose fibers and a filler. A plurality of discrete reduced ignition areas extend in a width direction on the paper substrate and are spaced along a length direction. At least one burn accelerating area is positioned in between a first reduced ignition area and a second reduced ignition area. The burn accelerating area comprises a burn promoting agent that has been applied to the paper substrate. In accordance with the present disclosure, the reduced ignition areas are free of the burn promoting agent. Placing the burn promoting agent only in between the reduced ignition areas allows for the reduced ignition areas to have a greater permeability while still having the required reduced ignition properties. For example, in accordance with the present disclosure, the reduced ignition areas may have a permeability that is no more than 70% lower than the permeability of the paper substrate. For instance, the permeability of the reduced ignition areas may be no more than about 65% less than the permeability of the paper substrate, such as no more than about 60% less, such as no more than about 55% less, such as no more than about 50% less, such as no more than about 45% less, such as no more than about 40% less than the paper substrate.

In one embodiment, the permeability of the reduced ignition areas can be greater than about 20 Coresta, such as greater than about 25 Coresta, such as greater than about 30 Coresta, such as greater than about 35 Coresta, such as greater than about 40 Coresta, such as greater than about 45 Coresta.

The discrete reduced ignition areas can have the above permeability characteristics while still providing the wrapper with the desired reduced ignition properties. For instance, in one embodiment, the reduced ignition areas can have a diffusivity of less than about 0.5 cm/s at 23° C. In an alternative embodiment, when the wrapper is incorporated into a smoking article and tested according to ASTM Test E2187-09, at least 75% of the smoking articles self-extinguish due to the presence of the reduced ignition areas.

In an alternative embodiment, the present disclosure is directed to a wrapper for a smoking article that includes a paper substrate comprising cellulose fibers and a filler. A plurality of discrete reduced ignition areas extend in a width direction of the paper substrate and are spaced along a length direction. Each discrete reduced ignition area comprises a reduced ignition composition that has been applied to the paper substrate. The reduced ignition composition in accordance with the present disclosure is free of any cellulose fibers or particles. At least one burn accelerating area is located on the wrapper and is positioned in between a first reduced ignition area and a second reduced ignition area. The burn accelerating area comprises a burn promoting agent. In accordance with the present disclosure, the reduced ignition areas are free of the burn promoting agent. Through the above construction, the reduced ignition areas can have a relatively high permeability such as the permeability characteristics described above.

In still another embodiment, the present disclosure is directed to a wrapper for a smoking article. The wrapper comprises a paper substrate comprising cellulose fibers and a filler. A plurality of discrete reduced ignition areas extend in a width direction on the paper substrate and are spaced along a length direction. At least one burn accelerating area is positioned in between a first reduced ignition area and a second adjacent reduced ignition area. The burn accelerating area comprises a burn promoting agent. The burn accelerating area includes a first edge facing the first reduced ignition area and a second edge facing the second reduced ignition area.

The wrapper further includes at least one untreated area. The untreated area is located between the first edge of the burn accelerating area and the first reduced ignition area. In one embodiment, the wrapper can include a second untreated area that is located between the second edge of the burn accelerating area and the second reduced ignition area. In accordance with the present disclosure, the untreated areas and the reduced ignition areas are free of the burn promoting agent.

According to the above embodiment, as a burning coal advances along a smoking article incorporating the wrapper, the burning coal enters a discrete reduced ignition area, then enters an untreated area, then enters a burn accelerating area. From the burn accelerating area, the burning coal may burn through another untreated area and then into a second discrete reduced ignition area. In this manner, a controlled burn rate profile along the entire length of the smoking article can be produced. In addition, the smoking article can have the desired reduced ignition characteristics.

The present disclosure is also directed to a method for increasing the permeability of a reduced ignition area in a paper wrapper for a smoking article with reduced ignition proclivity. The wrapper comprises a paper substrate comprising cellulose fibers and a filler. A plurality of discrete reduced ignition areas extend in a width direction on the paper substrate and are spaced along a length direction. At least one burn accelerating area is positioned in between a first reduced ignition area and a second reduced ignition area. The burn accelerating area comprises a burn promoting agent that has been applied to the paper substrate. In accordance with the present disclosure, the reduced ignition areas are free of the burn promoting agent.

According to the method above, in one embodiment, the wrapper may further include a burn accelerating area that includes a first edge facing the first reduced ignition area and a second edge facing the second reduced ignition area. The wrapper may also include at least one untreated area. The untreated area is located between the first edge of the burn accelerating area and the first reduced ignition area. In one embodiment, the wrapper can include a second untreated area that is located between the second edge of the burn accelerating area and the second reduced ignition area. In accordance with the present disclosure, the untreated areas and the reduced ignition areas are free of the burn promoting agent. Through the above methods, the reduced ignition areas can have a greater permeability while still having the desired reduced ignition properties.

The present disclosure is also directed to the use of a paper substrate for the preparation of a wrapper for a smoking article. In one embodiment, the present disclosure is also directed to the use of a burn promoting agent for the preparation of a wrapper for a smoking article. In one embodiment, the present disclosure is also directed to the use of a burn promoting agent for increasing the permeability of the reduced ignition areas in a wrapper for a smoking article with reduced ignition proclivity. According to the uses above, the paper substrate comprises cellulose fibers and a filler. A plurality of discrete reduced ignition areas extend in a width direction on the paper substrate and are spaced along a length direction. At least one burn accelerating area is positioned in between a first reduced ignition area and a second reduced ignition area. The burn accelerating area comprises a burn promoting agent that has been applied to the paper substrate. In accordance with the present disclosure, the reduced ignition areas are free of the burn promoting agent.

According to any of the uses above, in one embodiment, the paper substrate may further include a burn accelerating area that includes a first edge facing the first reduced ignition area and a second edge facing the second reduced ignition area. The wrapper may also include at least one untreated area. The untreated area is located between the first edge of the burn accelerating area and the first reduced ignition area. In one embodiment, the wrapper can include a second untreated area that is located between the second edge of the burn accelerating area and the second reduced ignition area.

The paper wrapper used in the above described embodiments can generally be made from cellulosic fibers and filler particles. The cellulosic fibers, for instance, may comprise flax fibers, softwood fibers, hardwood fibers, and mixtures thereof. The filler particles, on the other hand, can comprise any suitable filler particles, such as calcium carbonate or a metal oxide, such as magnesium oxide, iron oxide, and/or titanium dioxide. The filler particles may be present in the paper wrapper in an amount from about 10% to about 50% by weight, such as from about 20% to about 40% by weight.

Unexpectedly, it has also been discovered that in some applications, smoking articles incorporating paper wrappers made according to the present disclosure have reduced carbon monoxide delivery.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which:

FIG. 1 is a perspective view of a smoking article made in accordance with the present disclosure;

FIG. 2 is an exploded view of the smoking article illustrated in FIG. 1; and FIG. 3 is a perspective view of another embodiment of a smoking article made in accordance with the present disclosure.

Repeat use of reference characters in the present specification and drawings is intended to represent the same or analogous features or elements of the present invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations.

For purposes of explanation of the invention, the embodiments and principles of the invention will be discussed in regards to a cigarette. However, this is for the purposes of explanation of the invention only and is not meant to limit the invention only to cigarettes. Any manner of smoking article is within the scope and spirit of the invention.

The present disclosure relates to a smoking article, and a wrapper for a smoking article, having improved ignition proclivity control characteristics. "Ignition proclivity" is a measure of the tendency of the smoking article or cigarette to ignite a flammable substrate if the burning cigarette is dropped or otherwise left on a flammable substrate.

A test for ignition proclivity is referred to as the "Cigarette Extinction Test". The Cigarette Extinction Test is ASTM Test No. E2187-09 using 10 layers of filter paper. In the Cigarette Extinction Test, a lit cigarette is placed on 10 layers of filter paper. If the cigarette self extinguishes, the cigarette passes the test. If the cigarette burns all the way to its end, however, the cigarette fails. Smoking articles made in accordance with the present invention can be designed to pass the above test.

In addition to the above test, smoking articles having reduced ignition proclivity cigarettes are typically also tested for "free air self-extinguishment" (FASE). During the free air extinguishment test, the smoking articles are allowed to burn in the free air (within a fume hood while being held by a pin) without being puffed and without being placed on an adjacent surface. In most applications, it is desirable for a smoking article to pass the cigarette extinction test while not self-extinguishing when left burning in the free air. Thus, lower FASE rates are preferred. Of particular advantage, smoking articles constructed in accordance with the principles of the present invention may be configured to self extinguish when placed on an adjacent surface but yet have relatively low FASE rates.

In the past, the assignee of the present application has obtained various patents directed to smoking articles with reduced ignition proclivity characteristics. For example, paper wrappers treated with a film-forming composition that forms treated discrete areas on the wrapper are disclosed in U.S. Pat. No. 6,779,530 to Peterson et al. and U.S. Pat. No. 6,725,867 to Kraker, which are both incorporated herein by reference.

In both the '530 patent and in the '867 patent, the film-forming composition is described as, in one embodiment, being applied as circumferential cross-directional bands. The film-forming composition is a composition that is capable of forming a continuous film and is to be differentiated from forming bands from a fibrous material. The bands are spaced apart from each other on the cigarette wrapper along the length of the cigarette. Both patents discuss applying the film-forming composition to an outside surface of the paper wrapper or to an inside surface of the paper wrapper so that the treated areas are adjacent to a tobacco filler.

The assignee of the present application has also made reduced ignition paper wrappers for cigarettes that included treated discrete areas made from a cellulosic slurry. Such wrappers may be described, for instance, in U.S. Pat. No. 5,417,228 to Baldwin et al.; U.S. Pat. No. 5,474,095 to Allen et al.; U.S. Pat. No. 5,534,114 to Outright et al.; and U.S. Pat. No. 5,997,691 to Gautam et al., which are all incorporated herein by reference. The treated areas are made from fibrous cellulose, such as fibers, fibrils or microfibrils. The additional slurry applied to the paper forms a fibrous mat on top of the paper.

In the past, cigarette wrappers, including cigarette wrappers having reduced ignition proclivity characteristics, have been treated with a burn promoting agent, such as a citrate. The citrate is typically applied to the paper to improve ash appearance. The burn promoting agent is applied over the entire surface area of the paper typically before the treated discrete areas are formed on the wrapper. The present inventors, however, unexpectedly discovered that various benefits and advantages can be obtained if the burn promoting agent is applied to the wrapper only in between the discrete reduced ignition areas.

For example, because the reduced ignition areas do not contain a burn promoting agent, it was discovered that the reduced ignition areas can have a higher permeability while still having the desired reduced ignition characteristics. Because no burn promoting agent is present in the reduced ignition areas on the wrapper, for instance, the wrapper decomposes at a higher temperature within the reduced ignition areas. As a consequence, the reduced ignition areas can have a higher permeability while still having reduced ignition proclivity characteristics and thus being able to pass the Cigarette Extinction Test when incorporated into a cigarette as described above.

Ultimately, less material can be applied to the wrapper when producing the reduced ignition areas. Applying smaller amounts of an ignition reducing composition to the wrapper minimizes any adverse impacts on taste. Wrappers made according to the present disclosure thus produce mainstream smoke deliveries that are more comparable to conventional wrappers made in the past that did not include any reduced ignition areas.

Applying lesser amounts of a reduced ignition composition to the wrapper and/or producing reduced ignition areas having a higher permeability can lead to the design of smoking articles that have lower carbon monoxide deliveries. A reduction in carbon monoxide may be observed even if the ASTM cigarette extinction test percentage does not substantially change. Thus, it was also unexpectedly discovered that many embodiments of the present disclosure produce lower carbon monoxide levels, especially in relation to tar levels.

In U.S. Patent Publication No. 2011/0290436 to Dumas et al., a paper for a cigarette is disclosed comprising areas treated with a coating formulation adapted to reduce the ignition propensity. The '436 application is particularly directed to forming the treated areas from nanoparticles of cellulose having a median dimension equal to or less than 5 micrometers. The '436 application states that accelerating salts may be applied to the non-treated areas. The '436 application states, however, that a comparison between the tests conducted firstly on fully citrated papers and the test conducted on papers discretely coated with the combustion accelerating saline solution showed that this type of coating has very little impact on the permeability of the low ignition propensity bands. In fact, the permeability of the LIP areas in the examples of the '436 application are all very low. The '436 application indicates by the examples that permeabilities need to be around 10 Coresta in order to produce a cigarette that passes ASTM Test E2187-09 greater than 75% of the time.

In view of the '436 application, the results discovered by the present inventor are even more surprising and unexpected. As will be shown in the examples below, the present inventors discovered that when a burn promoting agent is only applied in between the reduced ignition areas, the reduced ignition areas can have a substantially higher permeability while still retaining the desired reduced ignition characteristics. As described above, the '436 application teaches that the treated areas must include nanoparticles of cellulose. It is believed that many benefits and advantages of the present disclosure can be obtained when using non-cellulose materials, such as non-fibrous and non-particle cellulose materials. For instance, since burn promoting agents are not applied uniformly over the surface of the wrapper, according to the present disclosure, the reduced ignition composition is applied to the wrapper in areas that are free of any burn promoting agent. The reduced ignition composition may comprise, for instance, a non-fibrous film-forming composition.

Generally, paper wrappers made according to the present disclosure contain cellulosic fibers in combination with filler particles. The cellulosic fibers can be, for instance, flax fibers, softwood fibers, hardwood fibers, or mixtures thereof. In order to vary the properties of the paper web as desired, various mixtures of cellulosic fibers can be used and the extent to which the fibers are refined can also be varied.

The filler particles incorporated into the paper web can vary depending upon the particular application. In general, any suitable filler may be used. The filler can be, for instance, calcium carbonate particles or metal oxide particles. Suitable metal oxide particles include magnesium oxide particles, iron oxide, or titanium dioxide particles. The total filler loading added to the paper web can be from about 10% by weight to about 50% by weight, such as from about 20% by weight to about 40% by weight.

Paper wrappers made according to the present disclosure can have any suitable permeability and basis weight as desired based upon the particular application. The permeability of the paper wrapper, for instance, can generally be from about 10 Coresta units to about 200 Coresta units. In some applications, the permeability can be between about 15 Coresta units to about 55 Coresta units. In one embodiment of the present invention, however, the initial permeability of the paper wrapper is relatively high. For instance, in one embodiment, the permeability of the paper wrapper can be from about 50 Coresta units to about 110 Coresta units. In various embodiments, for example the initial permeability of the paper wrapper may be greater than about 60 Coresta units, greater than about 70 Coresta units, greater than about 90 Coresta units, or greater than about 100 Coresta units. The initial permeability of the paper wrapper is generally less than about 160 Coresta units, such as less than about 140 Coresta units, such as less than about 120 Coresta units.

The basis weight of cigarette wrapping paper is usually between about 15 gsm to about 60 gsm, and more particularly between about 15 gsm to about 40 gsm. Wrapping papers according to the present invention can be made within any of these ranges.

In accordance with the present disclosure, a reduced ignition composition is applied to the paper wrapper at discrete locations in order to form reduced ignition areas. The reduced ignition areas are designed to cause a smoking article incorporating the wrapper to self-extinguish if left burning on an adjacent surface. In this regard, an ignition reducing composition is applied to the wrapper in an amount sufficient for the wrapper to have certain characteristics and properties. For instance, in one embodiment, an ignition reducing composition is applied to the wrapper to produce ignition reducing areas that have a diffusivity and have a certain surface area that causes a smoking article that incorporates the wrapper to self-extinguish.

In accordance with the present disclosure, the ignition reducing composition is applied to the wrapper or paper substrate where the wrapper or paper substrate remains untreated with any other chemicals. For instance, the ignition reducing composition can be applied to the paper wrapper in areas where the paper wrapper remains in its virgin state without any post-processing treatments. For instance, in accordance with the present disclosure, the reduced ignition areas are applied to the wrapper in areas where the wrapper has not been treated with a burn promoting agent. It should be understood, however, that many wrappers are produced with residual amounts of burn promoting agent due to the burn promoting agent being present in the fiber furnish, in the recycled water, or somehow be present on the forming fabrics or papermaking equipment. Thus, as used herein, untreated with a burn promoting agent refers to areas on the paper wrapper where topical application of a burn promoting agent by size or chemical press, printing, spraying or the like has not occurred.

In accordance with the present disclosure, a burn promoting agent is applied to the paper wrapper at locations in between the discrete reduced ignition areas. The burn promoting agent is applied in order to control the overall burn characteristics of the smoking article while also providing the smoking article with excellent ash conditioning properties. According to the present disclosure, even when the burn promoting agent applied to the wrapper is present between the discrete reduced ignition areas, the wrapper may still exhibit a suitable ash and provide a reduced carbon monoxide level.

The present disclosure is also directed to a method for increasing the permeability of a reduced ignition area in a paper wrapper for a smoking article with reduced ignition proclivity. The wrapper comprises a paper substrate comprising cellulose fibers and a filler. A plurality of discrete reduced ignition areas extend in a width direction on the paper substrate and are spaced along a length direction. At least one burn accelerating area is positioned in between a first reduced ignition area and a second reduced ignition area. The burn accelerating area comprises a burn promoting agent that has been applied to the paper substrate. In accordance with the present disclosure, the reduced ignition areas are free of the burn promoting agent.

According to the method above, in one embodiment, the wrapper may further include a burn accelerating area that includes a first edge facing the first reduced ignition area and a second edge facing the second reduced ignition area. The wrapper may also include at least one untreated area. The untreated area is located between the first edge of the burn accelerating area and the first reduced ignition area. In one embodiment, the wrapper can include a second untreated area that is located between the second edge of the burn accelerating area and the second reduced ignition area. In accordance with the present disclosure, the untreated areas and the reduced ignition areas are free of the burn promoting agent.

In accordance with the present disclosure, by placing the burn promoting agent only in the burn accelerating area, the methods above allow for the reduced ignition areas to have a greater permeability while still having the desired reduced ignition properties.

The present disclosure is also directed to the use of a paper substrate for the preparation of a wrapper for a smoking article. The paper substrate comprises cellulose fibers and a filler. A plurality of discrete reduced ignition areas extend in a width direction on the paper substrate and are spaced along a length direction. At least one burn accelerating area is positioned in between a first reduced ignition area and a second reduced ignition area. The burn accelerating area comprises a burn promoting agent that has been applied to the paper substrate. In accordance with the present disclosure, the reduced ignition areas are free of the burn promoting agent.

The present disclosure is also directed to the use of a burn promoting agent for the preparation of a wrapper for a smoking article. The wrapper comprises a paper substrate comprising cellulose fibers and a filler. A plurality of discrete reduced ignition areas extend in a width direction on the paper substrate and are spaced along a length direction. At least one burn accelerating area is positioned in between a first reduced ignition area and a second reduced ignition area. The burn accelerating area comprises a burn promoting agent that has been applied to the paper substrate. In accordance with the present disclosure, the reduced ignition areas are free of the burn promoting agent.

The present disclosure is also directed to the use of a burn promoting agent for increasing the permeability of the reduced ignition areas in a wrapper for a smoking article with reduced ignition proclivity. The wrapper comprises a paper substrate comprising cellulose fibers and a filler. A plurality of discrete reduced ignition areas extend in a width direction on the paper substrate and are spaced along a length direction. At least one burn accelerating area is positioned in between a first reduced ignition area and a second reduced ignition area. The burn accelerating area comprises a burn promoting agent that has been applied to the paper substrate. In accordance with the present disclosure, the reduced ignition areas are free of the burn promoting agent.

According to any of the uses above, in one embodiment, the paper substrate may further include a burn accelerating area that includes a first edge facing the first reduced ignition area and a second edge facing the second reduced ignition area. The wrapper may also include at least one untreated area. The untreated area is located between the first edge of the burn accelerating area and the first reduced ignition area. In one embodiment, the wrapper can include a second untreated area that is located between the second edge of the burn accelerating area and the second reduced ignition area.

In accordance with the present disclosure, by placing the burn promoting agent only in the burn accelerating area, the uses above allow for the reduced ignition areas to have a greater permeability while still having the desired reduced ignition properties.

In order to assist in describing and explaining the present disclosure, one embodiment of a smoking article in accordance with the present disclosure is illustrated generally in FIGS. 1 and 2. A smoking article (cigarette), generally 10, having improved ignition proclivity characteristics includes a tobacco column 12 within a wrapper 14. Article 10 may include a filter 26.

Paper web 14 defines an outer circumferential surface 16 when wrapped around tobacco column 12. Discrete areas 18 of outer circumferential surface 16 are treated with the ignition reducing composition. It should also be understood that treated areas 18 could also be disposed on the inner surface of wrapper 14. In other words, wrapper 14 could be rolled around tobacco column 12 so that treated areas 18 are adjacent to the tobacco.

The tobacco column 12 is generally made from shredded tobacco leaves and/or reconstituted tobacco. The tobacco column 12 can generally have a tobacco density of from about 200 mg/ml to about 250 mg/ml. For instance, the tobacco density can be from about 220 mg/ml to about 240 mg/ml.

In the embodiment illustrated in FIGS. 1 and 2, treated areas 18 are defined as circumferential cross-directional bands 24. Bands 24 are spaced apart from each other longitudinally along the length of cigarette 10. The bands 24 are indicated in phantom in FIG. 2. However, it should be understood that the treated areas can be essentially invisible in the formed cigarette as shown in FIG. 1. In other words, a smoker may not discern from any outward sign that the wrapper 14 has been treated in discrete areas 18. In this regard, treated areas 18 can have a smooth and flat texture essentially the same as the areas 28.

The width and spacing of bands 24 are dependent on a number of variables, such as the initial permeability of wrapper 14, density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing. For most applications, a minimum band width of 3 mm is desired. For example, the band width can be from about 4 mm to about 10 mm.

The spacing between bands 24 is also a factor of a number of variables. The spacing should not be so great that the cigarette burns for a sufficient length of time to ignite a substrate before the coal ever burns into a treated area 18. The spacing between bands 24 also affects the thermal inertia of the burning coal, or the ability of the coal to burn through the treated bands 24 without self-extinguishing. In the cigarettes tested, applicants have found that a band spacing of between 5 and 50 mm is appropriate and particularly between about 10 mm and 40 mm. However, it should be understood that the band spacing can be any suitable width as determined by any number of variables. For most applications, the smoking article can contain from 1 to about 3 bands using the above spacing.

In general, any suitable ignition reducing composition can be applied to the paper web 14. In one embodiment, for instance, the ignition reducing composition contains a film-forming material. For example, film-forming materials that can be used in accordance with the present invention include alginates, guar gum, pectin, polyvinyl alcohol, polyvinyl acetate, cellulose derivatives such as ethyl cellulose, methyl cellulose, and carboxymethyl cellulose, starch, starch derivatives, and the like.

In one particular embodiment, the film-forming material may comprise an alginate. In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In one embodiment, a relatively low molecular weight alginate may be used. For example, the alginates may have a viscosity of less than about 500 cP when contained in a 3% by weight aqueous solution at 25° C. More particularly, the alginates may have a viscosity of less than 250 cP at the above conditions, particularly less than 100 cP, and in one embodiment at a viscosity of about 20-60 cP. As used herein, viscosity is determined by a Brookfield LVF Viscometer with a suitable spindle according to the viscosity.

At the above lower viscosity levels, alginate compositions can be formed at a higher solids content, but yet at a low enough solution viscosity to permit the application of the composition to a paper wrapper using conventional techniques. For example, the solids content of an alginate solution made in accordance with the present invention can be greater than about 6%, particularly greater than about 10%, and more particularly from about 10% to about 20% by weight.

At the above solids levels, alginate compositions used in accordance with the present invention can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate film-forming composition can be adjusted depending upon the manner in which the composition is being applied to the paper. For instance, the solution viscosity of the composition can be adjusted depending upon whether or not the composition is being sprayed onto the paper or printed onto the paper.

In other embodiments, it should also be understood that depending upon the application a relatively high molecular weight alginate may be used. For example, the alginate may have a viscosity of greater than about 500 cP when contained in a 3% by weight aqueous solution at 25° C.

In addition to the film-forming material, the film-forming composition applied to the paper wrapper can contain various other ingredients.

For instance, in one embodiment, a filler can be contained within the composition. The filler can be, for instance, calcium carbonate, calcium chloride, calcium lactate, calcium gluconate, and the like. In addition to calcium compounds, other various particles may be used including magnesium compounds such as magnesium oxide, clay particles, and the like.

The ignition reducing composition, in one embodiment, can be water based. In particular, the ignition reducing composition may comprise an aqueous dispersion or aqueous solution. Alternatively, the ignition reducing composition prior to being applied to the paper wrapper may comprise a non-aqueous solution or dispersion. In this embodiment, for instance, an alcohol may be present for applying the composition to the wrapper.

As opposed to a film-forming composition, the ignition reducing composition may also comprise a cellulose slurry. As used herein, a slurry containing papermaking materials is not a film-forming composition. The cellulose slurry applied to the paper substrate may comprise fibrous cellulose, one or more fillers, and/or cellulose particles. As used herein, cellulose fibers and cellulose particles are to be differentiated from derivatized cellulose such as carboxymethyl cellulose. Cellulose fibers and cellulose particles, for instance, are not water soluble. In one embodiment, the cellulose slurry applied to the paper substrate may comprise microcrystalline cellulose.

Although cellulose as described above may be used to form the reduced ignition areas, some disadvantages may occur when using these materials. For example, the use of cellulose particles may actually interfere with some of the advantages and benefits of the present disclosure. For instance, the use of cellulosic slurries may interfere with the ability to obtain treated areas with higher permeabilities at the desired reduced ignition proclivity characteristics.

Once the ignition reducing composition is formulated, the composition can be applied to a paper wrapper in discrete areas. The manner in which the composition is applied to the paper wrapper can vary. For example, the composition can be sprayed, brushed, applied with a moving orifice, or printed onto the wrapper. To form a treated area, the composition can be applied in a single pass or in a multiple pass operation. For instance, the composition can be applied to the wrapping paper in successive steps in order to form areas on the paper having reduced ignition proclivity. In general, during a multiple pass process, the treated areas can be formed by applying the composition during from about 2 to about 8 passes.

In accordance with the present disclosure, the areas 28 illustrated in FIG. 2 are treated with a burn promoting agent. In particular, the burn promoting agent is applied to the areas 28 leaving the treated areas 18 free of the burn promoting agent.

Examples of burn promoting agents include alkali metal salts, alkaline earth metal salts, and mixtures thereof. In one embodiment, the burn promoting agent may comprise a salt of a carboxylic acid. In particular examples, for instance, the burn promoting agent may comprise an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, and mixtures thereof. In one particular application, for instance, the burn promoting agent may comprise potassium citrate, sodium citrate, potassium succinate, sodium succinate, or mixtures thereof.

The amount of burn promoting agent applied to the areas 28 on the paper substrate 14 can vary depending upon the particular application. In one embodiment, for instance, the burn promoting agent may be applied to the areas 28 in an amount of at least about 0.1% by weight, such as at least about 0.3% by weight, such as at least 0.5% by weight and less than about 5% by weight, such as less than about 2.5% by weight. In one embodiment, burn promoting agent may be applied in an amount from about 0.1% to about 5% by weight, such as from about 0.1% to about 2.5% by weight. The amount of burn promoting agent applied to the paper wrapper is based on the total weight of the paper wrapper and based on the weight of an anhydrous citric acid.

The amount of reduced ignition composition applied to the paper substrate can also vary. Applying the reduced ignition composition to the untreated paper allows for lesser amounts of the composition to be applied, especially when the composition comprises a film-forming composition. For instance, the composition can be applied to the paper substrate in an amount less than about 15% by weight, such as less than about 10% by weight, such as less than about 8% by weight. In general, the composition is applied in an amount greater than 1% by weight based upon the weight of the composition within the reduced ignition areas.

Through the process of the present disclosure, reduced ignition areas can be produced having a relatively high permeability while also having a relatively low diffusivity. For instance, the reduced ignition areas can have a permeability greater than 20 Coresta while still being capable of producing smoking articles that pass ASTM Test E2187-09 at least 75% of the time.

In one embodiment, for instance, the reduced ignition areas have a permeability that reduces the permeability of the paper substrate by no more than about 70%, such as by no more than about 65%, such as by no more than about 60%, such as by no more than about 55%, such as by no more than about 50%, such as by no more than about 45%, such as by no more than about 40%.

The permeability of the reduced ignition areas can depend upon various factors, especially the permeability of the paper substrate. In general, the reduced ignition areas can have a permeability of greater than about 20 Coresta, such as greater than about 25 Coresta, such as greater than about 30 Coresta, such as greater than about 35 Coresta, such as greater than about 40 Coresta, such as greater than about 45 Coresta.

In general, the reduced ignition areas have a diffusivity that is relatively low. The diffusivity can be measured at room temperature (23° C.). In general, the diffusivity at 23° C. of the reduced ignition areas is less than about 0.5 cm/s, such as less than 0.4 cm/s, such as less than 0.3 cm/s. In one embodiment, the reduced ignition areas may have a diffusivity of greater than about 0.1 cm/s, such as greater than about 0.15 cm/s while still having the desired reduced ignition proclivity characteristics.

Diffusivity is measured using a Sodium diffusivity tester.

Referring to FIG. 3, another embodiment of a smoking article made in accordance with the present disclosure is illustrated. Like reference numerals have been used to indicate similar elements.

As shown, a smoking article 10 is illustrated that includes a column of tobacco 12 surrounded by a wrapper 14 comprising a paper substrate. The wrapper 14 attaches the column of tobacco 12 to a filter 26.

In accordance with the present disclosure, the wrapper 14 includes reduced ignition areas 18 that provide the smoking article with reduced ignition proclivity characteristics. The reduced ignition areas 18 are directly applied to the wrapper 14 without any underlying chemical treatments. For instance, the reduced ignition areas 18 are free of any burn promoting agents.

The wrapper 14 is also treated with a burn promoting agent in areas 28. As shown, the areas 28 are located before, in between, and after the reduced ignition areas 18. A burn promoting agent is applied to the wrapper for controlling burn rate and improving the ash characteristics.

In the embodiment illustrated in FIG. 3, the wrapper 14 further includes untreated areas 50. The untreated areas 50 are located in between the areas 28 treated with the burn promoting agent and the reduced ignition areas 18.

By including at least one untreated area 50 on the wrapper 14, it is believed that various advantages and benefits may be obtained in certain embodiments. In the embodiment illustrated, for instance, the burning coal burns through an area 28 treated with a burn promoting agent. The burning coal then enters an untreated area before entering a reduced ignition area 18. From the reduced ignition area 18, the burning coal then burns through an untreated area 50 prior to entering an area 28 treated with a burn promoting agent. In this manner, the burn rate gradually slows as the coal enters the reduced ignition area 18. The presence of the untreated areas 50 may further provide control over the mainstream smoke and may produce a smoking article with an overall taste that is preferable to smokers.

The untreated areas 50 can have any suitable width depending upon the particular application. In one embodiment, for instance, the untreated areas 50 may have a width a width of at least 0.1 mm, such as at least 0.5 mm, such as at least 1 mm but less than about 10 mm, such as less than about 7.5 mm, such as less than about 5 mm, such as less than about 4 mm, such as less than about 3 mm, such as less than about 2 mm, such as less than about 1.5 mm. In one embodiment, the treated areas 50 may have a width of from about 0.1 mm to about 4 mm, such as from about 0.5 mm to about 2.0 mm.

When producing the wrapper 14 as shown in FIG. 3, in one embodiment, an untreated wrapper may be fed through a printing process. The printing process may include multiple stations. One station may print the burn promoting agent to produce the areas 28, while a second station may be used to produce the reduced ignition areas 18. The different print stations may be aligned with one another in order to leave certain areas of the paper substrate untreated and thus forming the untreated areas 50.

Once incorporated into a smoking article, paper wrappers made according to the present disclosure are well suited to reducing the ignition proclivity characteristics of the article. For instance, smoking articles made in accordance with the present disclosure can have an ASTM Test No. E2187-09 (Cigarette Extinction Test) pass rating of at least about 75%, such as at least about 80%, such as at least about 90%, such as even 100% pass rating. In addition, such smoking articles can also have a free air self-extinguishment (FASE) rating of less than about 50%, such as less than about 30%, such as less than about 20%, such as even less than about 10%.

The present disclosure may be better understood with reference to the following example.

EXAMPLE 1

The following tests were conducted to demonstrate some of the teachings of the present disclosure. In this example, a commercially available low ignition propensity (LIP) cigarette paper was compared with a wrapper made according to the present disclosure. The commercially available wrapper was uniformly treated over its entire surface area with a citrate. Bands of a reduced ignition composition were then applied to the wrapper. In comparison, a wrapper was constructed in which a burn promoting agent was only applied in between reduced ignition bands.

The commercial paper had a basis weight of 28 gsm, a permeability of 60 CU and was treated with 0.8% mixed citrate. The base paper contained relatively uniform amounts of fiber and a filler (calcium carbonate).

In contrast, the bands of the sample made according to the present disclosure were applied to regions that had no burn promoting agent present.

The following table shows a comparison of properties between the commercially available paper (Comparative Samples 1 and 3) and the paper of the present disclosure (Samples 2 and 4).

TABLE 1

Test Results

| Test Property | Comparative Sample 1 | Sample 2 | Comparative Sample 3 | Sample 4 |
|---|---|---|---|---|
| Base Permeability (CU) | 67.0 | 68.0 | 63.4 | 67.6 |
| Na/K citrate (wt % based on anhydrous citric acid) (between bands for Samples 2 and 4) | 0.78 | 0.65 | 0.84 | 0.90 |
| Band D* (cm/s) at 23° C. | 0.038 | 0.199 | 0.042 | 0.190 |
| Band Permeability (CU) | 11.1 | 36.8 | 9.7 | 28.1 |
| $CaCO_3$ (%) | 31.4 | 32.1 | * | * |
| Base basis weight (gsm) | 28 | 25 | 28 | 25 |
| ASTM (%) | 100 | 96 | 100 | 98 |
| FASE (%) | 98 | 20 | 98 | 15 |
| Puff number | 6.8 | 6.9 | * | * |
| Tar (mg/cig) | 18.5 | 17.4 | * | * |
| Nicotine (mg/cig) | 1.22 | 1.13 | * | * |
| CO (mg/cig) | 16.2 | 14.2 | * | * |
| CO/tar (mg/mg) | 0.88 | 0.82 | * | * |

*Property not tested.

As shown above, smoking articles made according to the present disclosure outperformed the comparative paper. The major differences were (1) much higher band permeability, and (2) lower tar, nicotine, and CO deliveries at an equivalent puff number. Also, the ASTM was above 90% for both articles so there was no noticeable drop off in LIP performance.

Therefore, Samples 2 and 4, with its reduced deliveries and improved taste, mitigated a multitude of the drawbacks associated with commercially available cigarette paper while maintaining good LIP performance.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A wrapper for a smoking article comprising:

a paper substrate comprising cellulose fibers and a filler, the paper substrate having a width and a length;

a plurality of discrete reduced ignition areas extending in the width direction on the paper substrate and being spaced along the length direction;

at least one burn accelerating area positioned in between a first reduced ignition area and a second adjacent reduced ignition area, the burn accelerating area comprising a burn promoting agent; and wherein the reduced ignition areas are free of the burn promoting agent and wherein the reduced ignition areas have a permeability of greater than 25 Coresta while having a diffusivity of less than about 0.5 cm/s at 23° C.

2. A wrapper as described in claim 1, further comprising:

at least one untreated area, the untreated area being located between a first edge of the burn accelerating area and the reduced ignition area; and wherein the untreated area and the reduced ignition areas are free of the burn promoting agent.

3. A wrapper as defined in claim 1, wherein the reduced ignition areas are formed from a non-fibrous film-forming composition.

4. A wrapper as defined in claim 1, wherein the reduced ignition areas comprise a starch composition.

5. A wrapper as defined in claim 1, wherein the reduced ignition areas comprise an alginate composition.

6. A wrapper as defined in claim 1, wherein the plurality of discrete reduced ignition areas comprise circumferential bands having a width of from about 3 mm to about 10 mm.

7. A wrapper as defined in claim 2, wherein the wrapper includes first and second untreated areas, the first untreated area being located between the first edge of the burn accelerating area and the first reduced ignition area, the second untreated area being located between a second edge of the burn accelerating area and a second reduced ignition area.

8. A wrapper as defined in claim 7, wherein the first and second untreated areas comprise circumferential bands having a width of from about 0.1 mm to about 4 mm.

9. A wrapper as defined in claim 1, wherein the reduced ignition areas comprise areas where a reduced ignition composition has been applied to the paper substrate in an untreated state.

10. A wrapper as defined in claim 1, wherein the reduced ignition areas have a diffusivity at 23° C. of from about 0.15 cm/s to about 0.5cm/s.

11. A smoking article comprising:

a column comprising a smokable tobacco; and a paper wrapper surrounding the column of the smokable tobacco, the paper wrapper comprising the wrapper of claim 1.

12. A smoking article as defined in claim 11, wherein the smoking article has a pass rating according to ASTM Test E2187-09 of at least 75%.

13. A smoking article as defined in claim 11, wherein the column comprising the smokable tobacco has a density of from about 200 mg/ml to about 250 mg/ml.

14. A wrapper for a smoking article comprising:

a paper substrate comprising cellulose fibers and a filler, the paper substrate having a width and a length;

a plurality of discrete reduced ignition areas extending in the width direction on the paper substrate and being spaced along the length direction, the reduced ignition areas being formed from a film-forming composition that is free from fibrous cellulose materials and free from particle cellulose materials:

at least one burn accelerating area positioned in between a first reduced ignition area and a second adjacent reduced ignition area, the burn accelerating area comprising a burn promoting agent; and wherein the reduced ignition areas are free of the burn promoting agent.

15. A wrapper as defined in claim 14, wherein the reduced ignition areas have a permeability of greater than 20 Coresta.

16. A wrapper as defined in claim 15, wherein, when the wrapper is incorporated into a smoking article having a tobacco density of from 200 mg/mi to 250 mg/ml and tested according to ASTM Test E2187-09, at least 75% of the smoking articles self extinguish.

17. A wrapper as described in claim 14, further comprising:

at least one untreated area, the untreated area being located between a first edge of the burn accelerating area and the reduced ignition area; and wherein the untreated area and the reduced ignition areas are free of the burn promoting agent.

18. A wrapper as defined in claim 17, wherein the wrapper includes first and second untreated areas, the first untreated area being located between the first edge of the burn accelerating area and the first reduced ignition area, the second untreated area being located between a second edge of the burn accelerating area and a second reduced ignition area.

19. A wrapper as defined in claim 18, wherein the first and second untreated areas comprise circumferential bands having a width of from about 0.1 mm to about 4 mm.

20. A wrapper as defined in claim 14, wherein the reduced ignition areas are formed from a non-fibrous film-forming composition.

21. A wrapper as defined in claim 14, wherein the reduced ignition areas comprise a starch composition or an alginate composition.

22. A wrapper as defined in claim 14, wherein the plurality of discrete reduced ignition areas comprise circumferential bands having a width of from about 3 mm to about 10 mm.

23. A wrapper as defined in claim 14, wherein the reduced ignition areas have a diffusivity at 23° C. of from about 0.15 cm/s to about 0.5 cm/s.

24. A smoking article comprising:

a column comprising a smokable tobacco; and a paper wrapper surrounding the column of the smokable tobacco, the paper wrapper comprising the wrapper of claim 14.

25. A smoking article as defined in claim 14, wherein the smoking article has a pass rating according to ASTM Test E2187-09 of at least 75%.

* * * * *